US006257352B1

(12) United States Patent
Nelson

(10) Patent No.: US 6,257,352 B1
(45) Date of Patent: Jul. 10, 2001

(54) ROCK BREAKING DEVICE

(76) Inventor: Craig Nelson, 10 Pine St. North, Luck, WI (US) 54853

( * ) Notice: Subject to any disclaimer, the term of this patent is extended or adjusted under 35 U.S.C. 154(b) by 0 days.

(21) Appl. No.: 09/435,400

(22) Filed: Nov. 6, 1999

Related U.S. Application Data

(60) Provisional application No. 60/107,442, filed on Nov. 6, 1998.

(51) Int. Cl.[7] ..... B25D 17/24

(52) U.S. Cl. ..... 173/211; 173/89

(58) Field of Search ..... 173/210, 211, 173/162.1, 206, 207, 131, 133, 89, 87, 137; 267/137

(56) References Cited

U.S. PATENT DOCUMENTS

| | | | |
|---|---|---|---|
| 873,517 | 12/1907 | DeWitt . | |
| 886,193 | 4/1908 | DeWitt . | |
| 1,015,732 | 1/1912 | Grice . | |
| 1,041,569 | 10/1912 | Bade . | |
| 1,495,968 | 5/1924 | Whitney . | |
| 1,609,136 | 11/1926 | Stevens . | |
| 1,665,046 | 4/1928 | Tucker . | |
| 1,731,836 | 10/1929 | Williams . | |
| 1,883,010 | 10/1932 | Sherwood . | |
| 1,884,946 | 10/1932 | Wineman . | |
| 1,943,420 | 1/1934 | Budd . | |
| 2,000,688 | 5/1935 | Burr . | |
| 2,018,096 | 10/1935 | Schorle . | |
| 2,162,416 | 6/1939 | Boddinghouse . | |
| 2,176,801 | 10/1939 | Pinazza . | |
| 2,180,034 | 11/1939 | Charles . | |
| 2,184,745 | 12/1939 | Kinneman . | |
| 2,252,017 | 8/1941 | McCrery . | |
| 2,295,489 | 9/1942 | Riemenschneider . | |
| 2,326,136 | 8/1943 | Garrett . | |
| 2,398,595 | 4/1946 | Powell . | |
| 2,519,477 | 8/1950 | Kind . | |
| 2,558,165 | 6/1951 | Anderson . | |
| 2,588,360 | 3/1952 | Cole . | |
| 2,628,599 | 2/1953 | Wilson . | |
| 2,723,532 | 11/1955 | Smith . | |
| 2,775,445 | 12/1956 | Goodloe . | |
| 2,798,363 | 7/1957 | Hazak . | |
| 2,899,934 | 8/1959 | Salengro . | |
| 2,912,564 | 11/1959 | Deffenbaugh . | |
| 2,929,361 | 3/1960 | Reynolds . | |
| 2,933,068 * | 4/1960 | Johnson et al. | 173/210 |
| 2,948,122 * | 8/1960 | Smith | 173/210 |
| 3,010,430 | 11/1961 | Allen . | |

(List continued on next page.)

FOREIGN PATENT DOCUMENTS

| | | | |
|---|---|---|---|
| 27994/77 | 8/1976 | (AU) . | |
| 299538 | 7/1917 | (DE) . | |
| 814727 * | 9/1951 | (DE) | 173/211 |
| 880317 | 3/1943 | (FR) . | |
| 253772 | 12/1948 | (FR) . | |
| 954342 | 12/1949 | (FR) . | |
| 140465 | 6/1921 | (GB) . | |
| 2035866A * | 6/1980 | (GB) | 173/211 |
| 358094521A * | 6/1983 | (JP) | 173/210 |

OTHER PUBLICATIONS

Robert D. Chellis—Pile Foundationos—Theory—Design—Practice, McGraw–Hill Book Company, Inc., 1951, pp. 96–97.

Operation and Maintenance Manual—Model MK III Rock Breaker, Talisker, U.S.A.

*Primary Examiner*—Scott A. Smith
(74) *Attorney, Agent, or Firm*—Moore & Hansen

(57) ABSTRACT

A device for breaking rocks comprising a substantially vertical guide column which houses a weight for delivering an impact to a tool held within a cushioned tool holding structure that is itself supported from the guide column by a resilient recoil assembly is herein disclosed.

18 Claims, 6 Drawing Sheets

U.S. PATENT DOCUMENTS

| | | | | |
|---|---|---|---|---|
| 3,017,810 | | 1/1962 | Jacklin . | |
| 3,028,841 | | 4/1962 | Leavell . | |
| 3,032,998 | | 5/1962 | Atkinson . | |
| 3,053,231 | * | 9/1962 | Fairchild | 173/211 |
| 3,058,341 | | 10/1962 | Heintzmann . | |
| 3,060,894 | | 10/1962 | Dean, Jr. . | |
| 3,168,324 | | 2/1965 | Kennell . | |
| 3,179,185 | | 4/1965 | O'Farrell . | |
| 3,253,663 | * | 5/1966 | Burgess, Jr. | 173/211 |
| 3,266,581 | * | 8/1966 | Cooley et al. | 173/210 |
| 3,327,516 | | 6/1967 | Anderson . | |
| 3,371,726 | | 3/1968 | Bouyoucos . | |
| 3,406,537 | | 10/1968 | Falkner, Jr. . | |
| 3,417,828 | | 12/1968 | Duyster . | |
| 3,446,293 | | 5/1969 | Guild et al. . | |
| 3,451,492 | | 6/1969 | Ekstrom . | |
| 3,456,741 | | 7/1969 | James . | |
| 3,469,504 | | 9/1969 | Neighhorn . | |
| 3,498,391 | | 3/1970 | Guild . | |
| 3,559,753 | | 2/1971 | Meri . | |
| 3,566,978 | | 3/1971 | Udert . | |
| 3,662,843 | | 5/1972 | Wise . | |
| 3,759,351 | | 9/1973 | Purple . | |
| 3,773,152 | | 11/1973 | Sitton . | |
| 3,788,404 | | 1/1974 | Koudelka . | |
| 3,791,463 | | 2/1974 | Pearson . | |
| 3,797,585 | | 3/1974 | Ludvigson . | |
| 3,817,091 | | 6/1974 | Frederick . | |
| 3,889,762 | | 6/1975 | Sumner . | |
| 3,889,765 | | 6/1975 | Henson . | |
| 3,910,357 | | 10/1975 | Nancarrow . | |
| 3,918,301 | | 11/1975 | Baer . | |
| 3,920,086 | | 11/1975 | Goppen . | |
| 3,969,988 | | 7/1976 | Maurer . | |
| 3,969,989 | | 7/1976 | Maurer . | |
| 3,975,918 | | 8/1976 | Jansz . | |
| 3,991,833 | | 11/1976 | Ruppert . | |
| 3,998,278 | | 12/1976 | Stilz . | |
| 4,029,158 | | 6/1977 | Gerrish . | |
| 4,036,310 | | 7/1977 | Schnell . | |
| 4,043,405 | | 8/1977 | Kuhn . | |
| 4,103,747 | | 8/1978 | Finney . | |
| 4,106,569 | | 8/1978 | Edgworth . | |
| 4,121,671 | | 10/1978 | West . | |
| 4,131,165 | | 12/1978 | Wanner . | |
| 4,155,287 | | 5/1979 | Selsam . | |
| 4,165,788 | | 8/1979 | Montabert . | |
| 4,173,130 | | 11/1979 | Sutliff . | |
| 4,187,917 | | 2/1980 | Bouyoucos . | |
| 4,237,987 | | 12/1980 | Sherman . | |
| 4,257,722 | | 3/1981 | Nakajima . | |
| 4,262,755 | | 4/1981 | Kuhn . | |
| 4,314,613 | | 2/1982 | Kuhn . | |
| 4,325,437 | | 4/1982 | Swindall . | |
| 4,340,210 | | 7/1982 | Townsend . | |
| 4,362,216 | | 12/1982 | Jansz . | |
| 4,366,870 | * | 1/1983 | Frederick | 173/210 |
| 4,390,307 | | 6/1983 | Rice . | |
| 4,421,180 | | 12/1983 | Fleishman . | |
| 4,444,348 | | 4/1984 | Campbell . | |
| 4,457,499 | | 7/1984 | Townsend . | |
| 4,465,145 | | 8/1984 | Kuhn . | |
| 4,479,552 | | 10/1984 | Chappelow . | |
| 4,513,828 | | 4/1985 | Chappelow . | |
| 4,527,674 | | 7/1985 | Mourray . | |
| 4,562,974 | | 1/1986 | Bezette . | |
| 4,626,138 | | 12/1986 | Boyes . | |
| 4,759,412 | | 7/1988 | Brazell, II . | |
| 4,796,956 | | 1/1989 | Fadeev . | |
| 4,824,003 | * | 4/1989 | Almeras et al. | 173/210 |
| 4,838,363 | | 6/1989 | MacOnochie . | |
| 4,858,701 | | 8/1989 | Weyer . | |
| 4,867,253 | | 9/1989 | Eftefield . | |
| 5,088,564 | | 2/1992 | Kobayaski . | |
| 5,117,924 | | 6/1992 | Bermingham . | |
| 5,167,396 | | 12/1992 | Burba . | |
| 5,363,835 | | 11/1994 | Robson . | |
| 6,000,477 | * | 12/1999 | Campling et al. | 173/210 |

* cited by examiner

ROCK BREAKING DEVICE

This application claims the benefit of U.S. Provisional Application No. 60/107,442, filed Nov. 6, 1998.

BACKGROUND OF THE INVENTION

The present invention is drawn to a device for breaking rocks. More specifically, the present invention is drawn to a device for breaking rocks which has a recoil assembly and a cushioned tool holding structure. For the purposes of this application, the term "rock " may be taken to include, rocks, stones, ores, construction materials, or the like.

OBJECTS OF THE INVENTION

Most devices for breaking rocks utilize a massive weight that is allowed to fall under the influence of gravity to impact a tool that is driven into the rock to break it. The forces imparted by repeated heavy blows from a weight being used to drive a tool can easily exceed the maximum allowed stresses in the materials from which typical rock breaking devices are made, e.g. steel and cast iron. In an effort to alleviate this problem, elastomeric cushions or buffers of rubber, leather, and even wood are placed around a rock breaking tool to cushion the blow of the weight on the tool. However, there is a problem with simply placing an elastomeric cushion or buffer between a falling weight and a tool. When a weight vertically compresses a buffer or cushion, the buffer or cushion responds by expanding laterally. Where this lateral expansion comes into contact with the side walls of a rock breaker, the force exerted upon the side walls of the rock breaker by the cushion or buffer may deform and even break the side walls of the rock breaking device. Furthermore, it often happens that a weight is allowed to drop within a device for breaking rocks when there is no object beneath the tool or where there is no support for the tool itself. In this case the entire force of the falling weight will impact sharply against the tool and the lower end of the rock breaking device in a destructive manner. This situation is called "bottoming out" in that the weight strikes the bottom of the rock breaking device rather than the force of the impact being transferred through the tool to a rock. Bottoming out a rock breaking device even once can cause severe damage to not only the rock breaking device but to a vehicle or stand to which the device is attached.

Therefore, its an objective of the present invention to provide a recoil buffer that is located outside of the main guide column or mast within which the weight or ram travels. In this manner, the force imparted to the rock breaking device may be cushioned and any damage to the rock breaking device will be directed to a component of the device that may be readily replaced rather than to the guide column or mast which is often the back bone of a rock breaking device.

Another object of the present invention is to provide a resilient isolating structure which will prevent damage to the rock breaking device and especially to the mast or guide column of the device when the weight is allowed to bottom out.

SUMMARY OF THE INVENTION

The device for breaking rocks of the present inventions comprises a hollow tubular mast having a top end and a bottom end and a channel formed therethrough from the top end to the bottom end. A weight for delivering an impact travels through the channel of the mast between the top and bottom ends thereof. A weight raising mechanism is coupled to the weight so as to raise the weight from the bottom end of the mast to the top end of the mast. The weight raising mechanism is further capable of releasing the weight so that the weight may fall under the influence of gravity to the bottom end of the mast. An attachment structure is welded to the mast to secure the rock breaking device to a vehicle, or alternatively, a stationary rock breaking structure.

In one embodiment of the present invention, a recoil assembly is mounted to the bottom end of the mast which comprises a plurality of isolator structures secured to the mast at a predetermined distance from the bottom end of the mast. The isolator structures support a recoil tube in resilient telescoping relation to the mast with the recoil tube being received over the mast. A tool holding structure comprising a nose block having a tool for striking rock slidably received in a bore formed therethrough is mounted to the lower end of the recoil tube. The tool received in the nose block is generally cylindrical and has a flat formed into a side thereof so that a retaining pin passing through the nose block will intersect the bore in the nose block. The pin also intersects the flat formed into the tool and thereby limits the travel of the tool within the nose block. An upper surface of the tool may extend above an upper surface of said nose block into a space that is bounded by the bottom end of the mast, the upper surface of the nose block, and by the inner walls of the recoil tube. A lower surface of the tool extends below a lower surface of the nose block and is free to be placed in contact with a rock that is to be broken. The lower end of the tool may be shaped in any desirable manner including but not limited to flat, rounded, pointed, and chisel shaped.

In this first embodiment, a recoil buffer is disposed within the space bounded by the bottom end of the mast, the upper surface of the nose block, and by the inner walls of the recoil tube. The recoil buffer has a bore formed therethrough in registration with the bore of the nose block such that the tool may slidably pass through both bores, with the upper surface of the tool being capable of being positioned above the upper surface of the recoil buffer. In this manner the weight delivers an impact to the upper surface of the tool when the weight is released to fall to the bottom end of the mast. The impact of the weight upon the tool will drive the upper surface of the tool downward and below the upper surface of the recoil buffer such that the weight will then come into contact with the recoil buffer. The elastomeric recoil buffer then absorbs and dissipates the impact forces of the weight that have not been transferred to the tool by elastically deforming in a known manner.

A reinforcing structure may be disposed within and affixed to the inner surface of the recoil tube around the recoil buffer. The recoil buffer and the reinforcing structure are sized so as to create a gap between the periphery of the recoil buffer and the reinforcing structure. In one embodiment of the present invention the gap is approximately ⅜".

The isolator structures in one embodiment comprise a bracket which opens towards the top end of the mast. The bracket has substantially parallel side plates affixed to the mast and a bottom plate affixed to the mast and to a bottom edge of the side plates. The bracket is sized to receive and retain an elastomeric isolator buffer with a cover plate arranged to be placed over the isolator buffer in the bracket. The cover plate, the isolator buffer and the bottom plate all have at least one bolt hole bored therethrough to permit at least one connecting bolt to be passed through each of the plurality of isolator structures. The connecting bolts are passed through bolt holes bored through an upper flange affixed to an upper end of the recoil tube and preferably secured with a nut. The upper flange of the recoil assembly is resiliently biased into contact with a lower surface of the plurality of isolator structures by the connecting bolts such that when impact forces are applied to the recoil tube so as to force the recoil tube downward with respect to the mast, the connecting bolts bear down on the cover plates which in turn compress the isolator buffers in a resilient manner. The isolator buffers regain their original dimensions when the impact forces have been dissipated.

The recoil assembly further comprises a lower flange that is affixed to the lower end of the recoil tube. This lower flange is provided with a plurality of bolt holes for securing the nose block to the recoil tube. In addition, the recoil assembly further comprises a plurality of plate shaped reinforcing gussets that are affixed to the outer surface of the recoil tube and to the upper and lower flanges so as to increase the stiffness of the recoil assembly.

The recoil buffer of the present invention is typically rectangular in cross section having chamfered or radiused corners, though it is to be understood that the recoil buffer is to be shaped to suit the interior of a given mast and recoil tube. Furthermore, the recoil buffer is typically fashioned from an elastomeric material such as polyurethane or rubber. What is more, the recoil buffer is located entirely outside the channel of the mast.

The recoil buffer is arranged to be vertically compressed by the impact of the weight and to expand laterally to contact the reinforcing structures so that the recoil buffer may thereby absorb and dissipate at least a portion of the impact of the weight on the recoil assembly.

In one embodiment of the present invention the guide column has four isolating structures welded to the mast. The isolating structures are spaced 90° from one another. The weight raising mechanism of the present invention may be a hydraulic mechanism, a pneumatic mechanism, or an internal combustion mechanism.

In another embodiment of the present invention, the nose block may be connected directly to a flange affixed to the bottom end of the hollow tube that acts as the mast. In this embodiment the device for breaking rocks comprises a hollow tube having a weight slidably disposed therein. A weight raising device for raising and releasing the weight to allow the weight to fall within the tube under the influence of gravity is coupled to the weight. An attachment structure is connected to the hollow tube for securing the device for breaking rocks to a stationary object or to a vehicle. The nose block is resiliently secured to the lower end of the hollow tube and has a bore formed therethrough that is constructed and arranged to slidably receive the tool therein. The tool is retained in the bore by a pin passed through the nose block that intersects the bore and a flat that is machined into the generally cylindrical tool. The nose block also has a recess of at least the same size as the lower surface of the weight formed into the upper surface thereof around the bore. The recoil buffer is disposed entirely within the recess in the nose block and also has a bore formed therethrough in registration with the bore in the nose block to allow the upper end of the tool to extend above the recoil buffer. In this manner the weight may impact the tool directly. The recoil buffer is constructed and arranged to resiliently absorb impact forces imparted thereto by the weight.

The isolator structures which resiliently secure the nose block to the hollow tube or mast comprise an elastomeric isolator buffer and a cover plate located on an upper surface of a flange that is secured to the lower end of the hollow tube. The isolator buffer is preferably sandwiched between the cover plate and the flange to evenly distribute the compressive forces that are applied to the isolator structures by the impact of the weight. The isolator buffer and cover plate each have at least one complementary bolt hole bored therethrough to permit a connecting bolt to be passed through the isolator structure and a complementary bolt hole in the flange and into the nose block. The bolts that are passed through the isolator structures and flanges into the nose block may be threaded directly into the nose block or secured using a nut. The connector bolts draw the nose block into contact with the lower surface of the flange. The arrangement of the isolator structure is such that the nose block is resiliently secured to the flange of the hollow tube so that when impact forces are applied to the nose block and thereby forcing the nose block downward, the connecting bolt will bear down on the cover plate and in turn compress the isolator buffer in a resilient manner. The isolator buffer regains its original dimensions after the impact forces have been absorbed and dissipated by the isolator buffer.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiments of the invention have been described, the details may be changed without departing from the invention, which is defined by the claims.

DETAILED DESCRIPTION OF THE INVENTION

Figure 1:
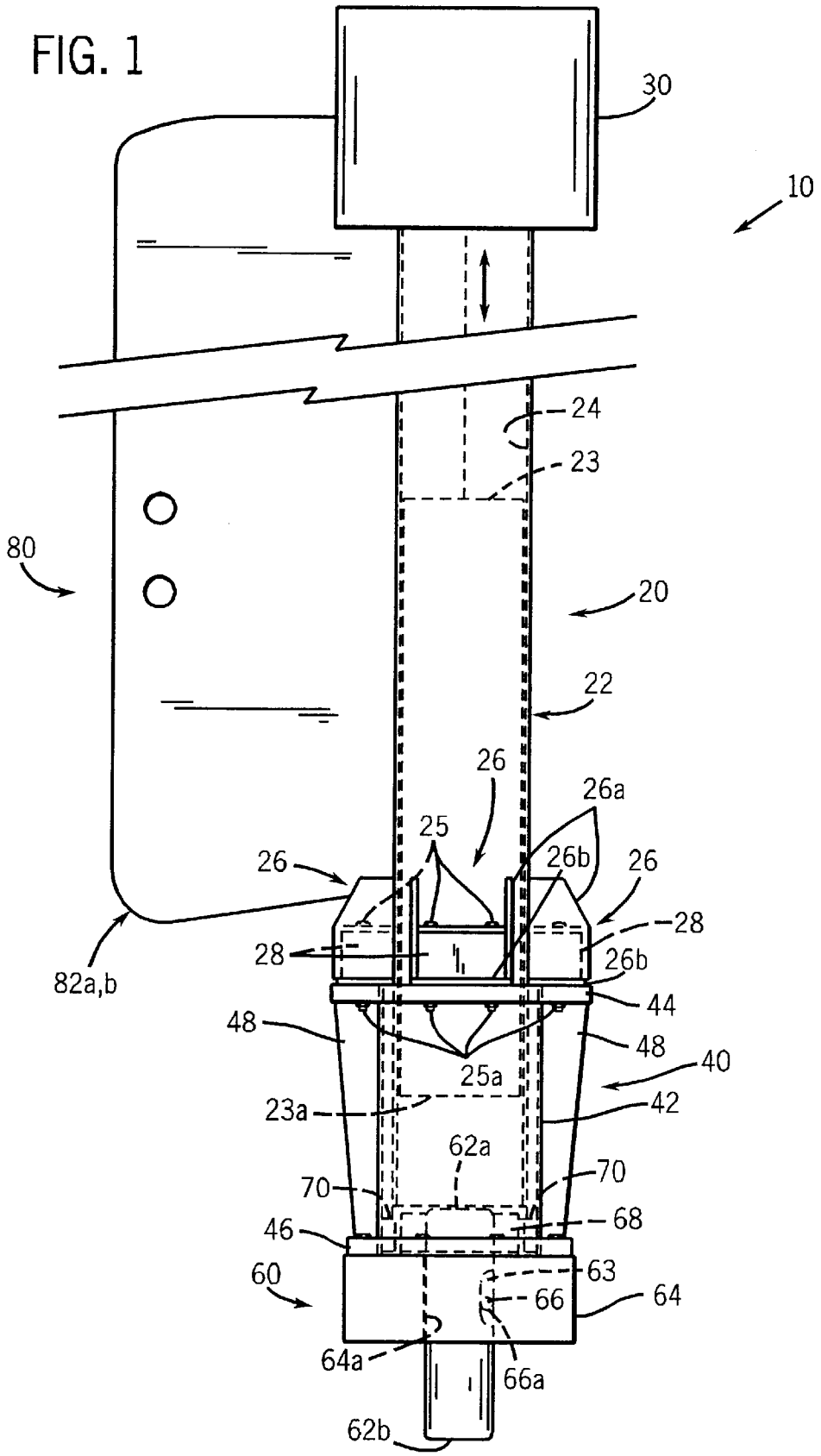
FIG. 1 is a side elevation of a rock breaking device according to the present invention.

The rock breaking device 10 of the present invention is generally comprised of a guide column 20 constructed and arranged to permit the free vertical movement therethrough of an impact weight 23; a weight raising mechanism 30 for raising and releasing the impact weight 23 within the guide column 20; a recoil assembly 40 secured to a lower end of the guide column 20; a tool holding structure 60 mounted to the lower end of the recoil assembly 40; and a vehicle attachment structure 80 which is secured to the guide column 20 to provides a point of attachment for the rock breaking device 10 to a vehicle such as a front-end loader or excavator (not shown) which is used to transport and position the rock breaking device 10. Alternatively, the rock breaking device 10 may be mounted upon a stationary rock breaking structure or suspended from a crane.

The guide column 20 of the rock breaking device 10 is comprised of a tubular mast 22 which may have a circular or square cross section. One embodiment of the present invention utilizes a mast 22 having a square cross section, however the mast 22 may have any of a number of suitable cross-sectional shapes including but not limited to square, rectangular, elliptical, or circular. The mast 22 is typically fashioned from a high strength steel. The mast 22 has a channel 24 running therethrough which guides the vertical travel of an impact weight 23. The impact weight 23 is typically fashioned of a steel material though it is to be understood that other materials may also be used. However, it is a requirement that the impact weight 23 fashioned of a material strong enough to prevent the rapid deformation of a lower impact surface 23A of the weight 23.

The impact weight 23 is coupled to a weight raising mechanism 30 mounted adjacent the upper end of the guide column 20. The weight raising mechanism 30 may be any of a number of well known mechanisms capable of raising and releasing a heavy objection such as the impact weight 23 of the present invention. Examples of suitable mechanisms include hydraulic lifting mechanisms, pneumatic lifting mechanisms, and mechanical mechanisms which may include cable and pulley structures or rotating cam mechanisms. The only requirements for the weight raising mechanism 30 is that the mechanism 30 be capable of repeatedly lifting and subsequently releasing the impact weight 23 to allow it to fall within the channel 24 of the mast 22 under the influence of gravity. Power for the weight raising mechanism 30 is typically supplied by the vehicle or structure upon which the rock breaking device 10 is mounted. For example, an air compressor, hydraulic pump, or generator, may be mounted upon the vehicle or structure to which the rock breaking device 10 is mounted so as to provide the motive power to the weight raising mechanism 30. Alternatively, power for the weight raising mechanism may be provided by an internal combustion engine coupled directly to the weight raising mechanism.

The vehicle attachment structure 80 of one preferred embodiment of the present invention is comprised of a pair of parallel side plates 82A, 82B which are affixed longitudinally to the guide column 20. The plates are maintained in their parallel arrangement by a number of brackets welded therebetween (not shown) in a well known manner. The brackets are further arranged in a known manner to secure the rock breaking device 10 to a vehicle which will be used to deploy the rock breaking device 10. As indicated above, a suitable vehicle would be a front-end loader or an excavator capable of movement through the environments where a rock breaker 10 would be used, typically in a mine, a rock quarry, or at a construction site. The attachment holes 84 are designed to fit the structures generally intended to mount an excavating bucket to either a front-end loader or an excavator.

The rock breaking device 10 functions by transmitting forces from the dropped impact weight to a target rock through a tool 62 mounted in the tool holding structure 60. In order to prevent the massive forces generated by the falling impact weight 23 from rapidly destroying the tool holding structure and the guide column 20, a recoil assembly 40 and a cushioned tool holding structure 60 have been provided.

The recoil assembly 40 is comprised of a recoil tube 42 having an upper flange 44 and a lower flange 46 secured to the upper and lower ends thereof, respectively. The recoil tube 42 is supported around the lower end of the guide column in telescoping, concentric fashion from a number of isolator structures 26 which are secured to the mast 22 a predetermined distance from the lower end of mast 22.

Figure 2:
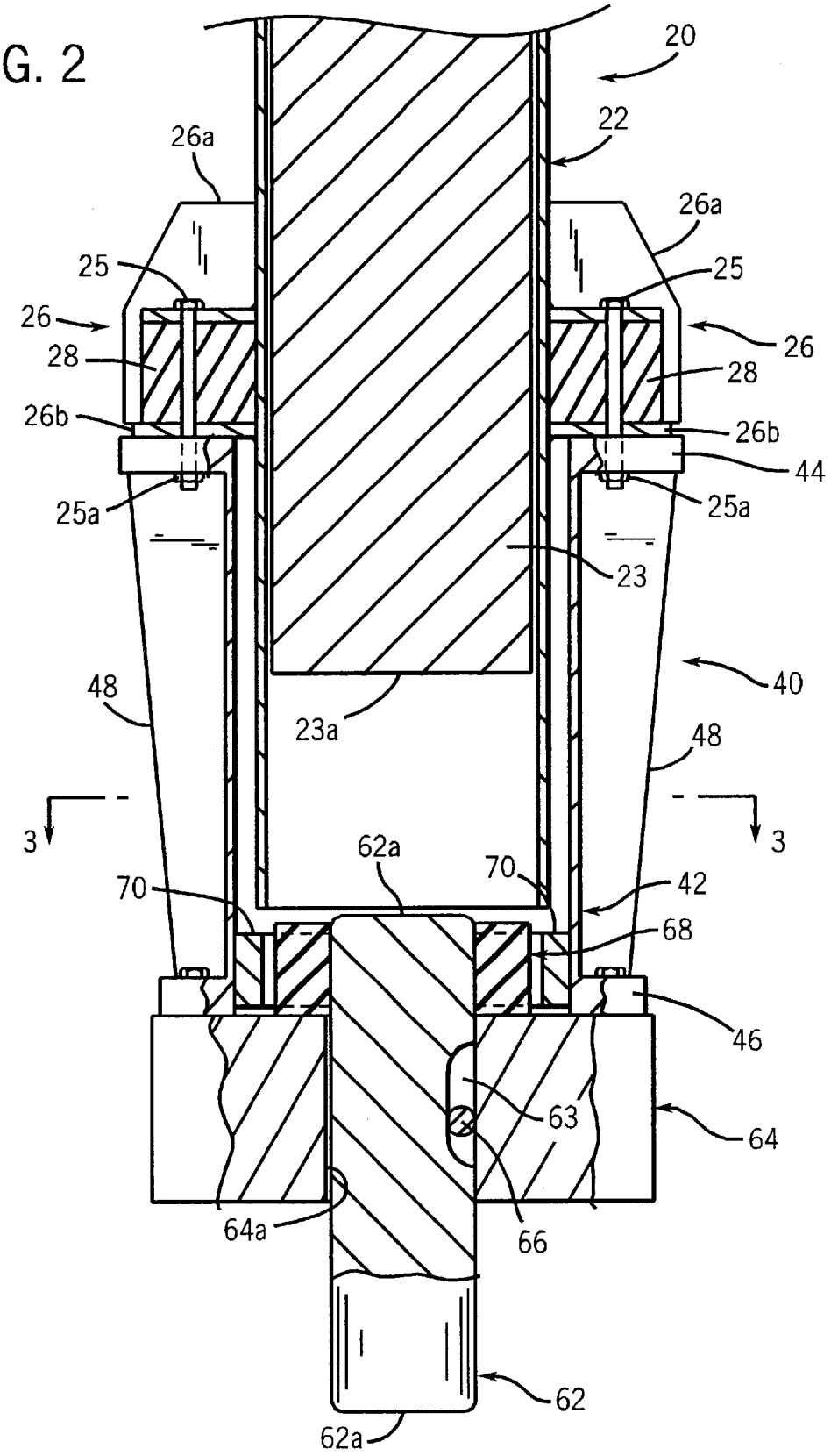
FIG. 2 is a close-up view of the lower end of the guide column and the recoil assembly attached thereto of the rock breaking device of the present invention.
Figure 3:
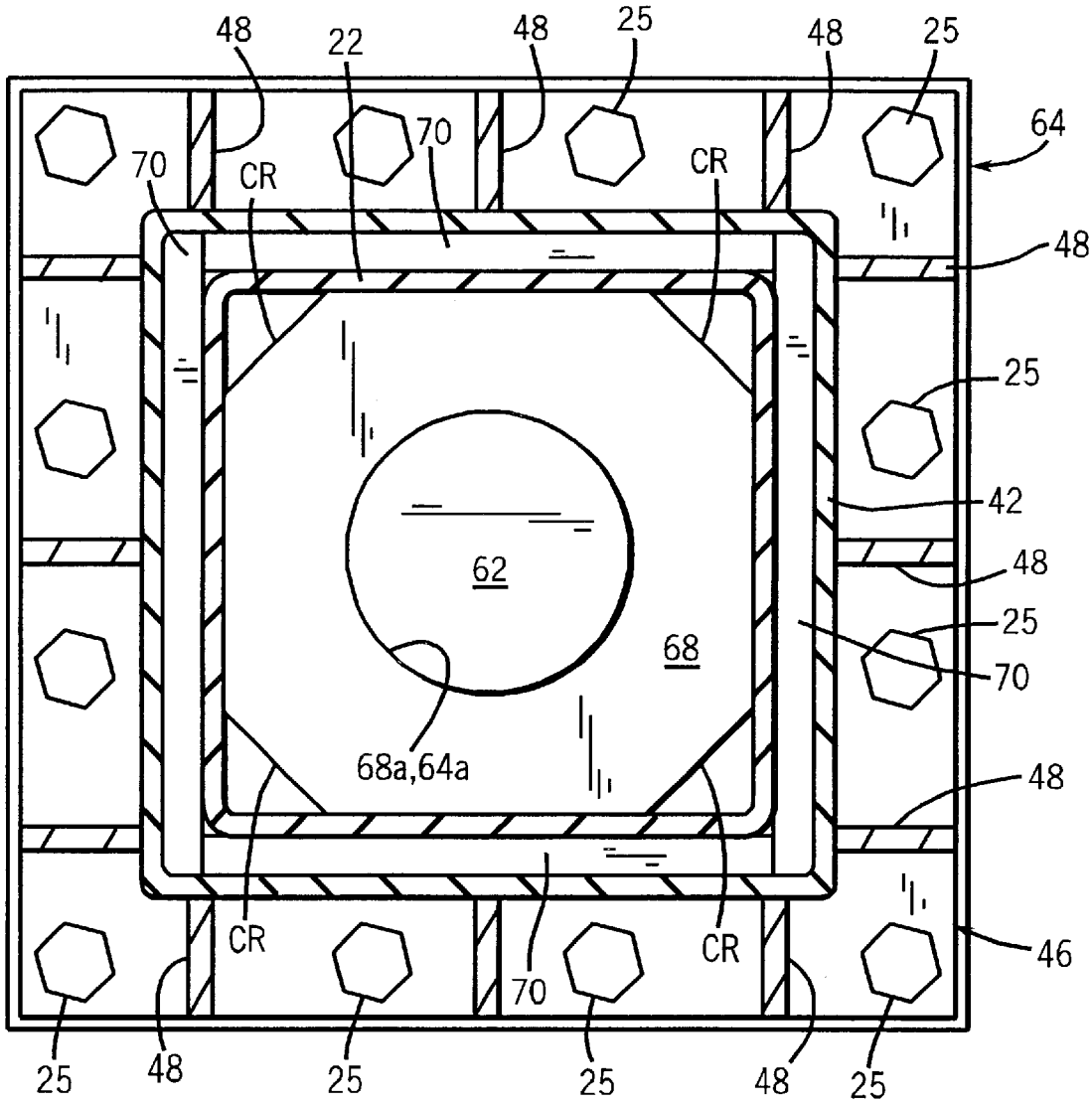
FIG. 3 is sectional view of the recoil assembly of the rock breaking device of the present invention taken along section lines 3—3 in FIG. 2.
Figure 4:
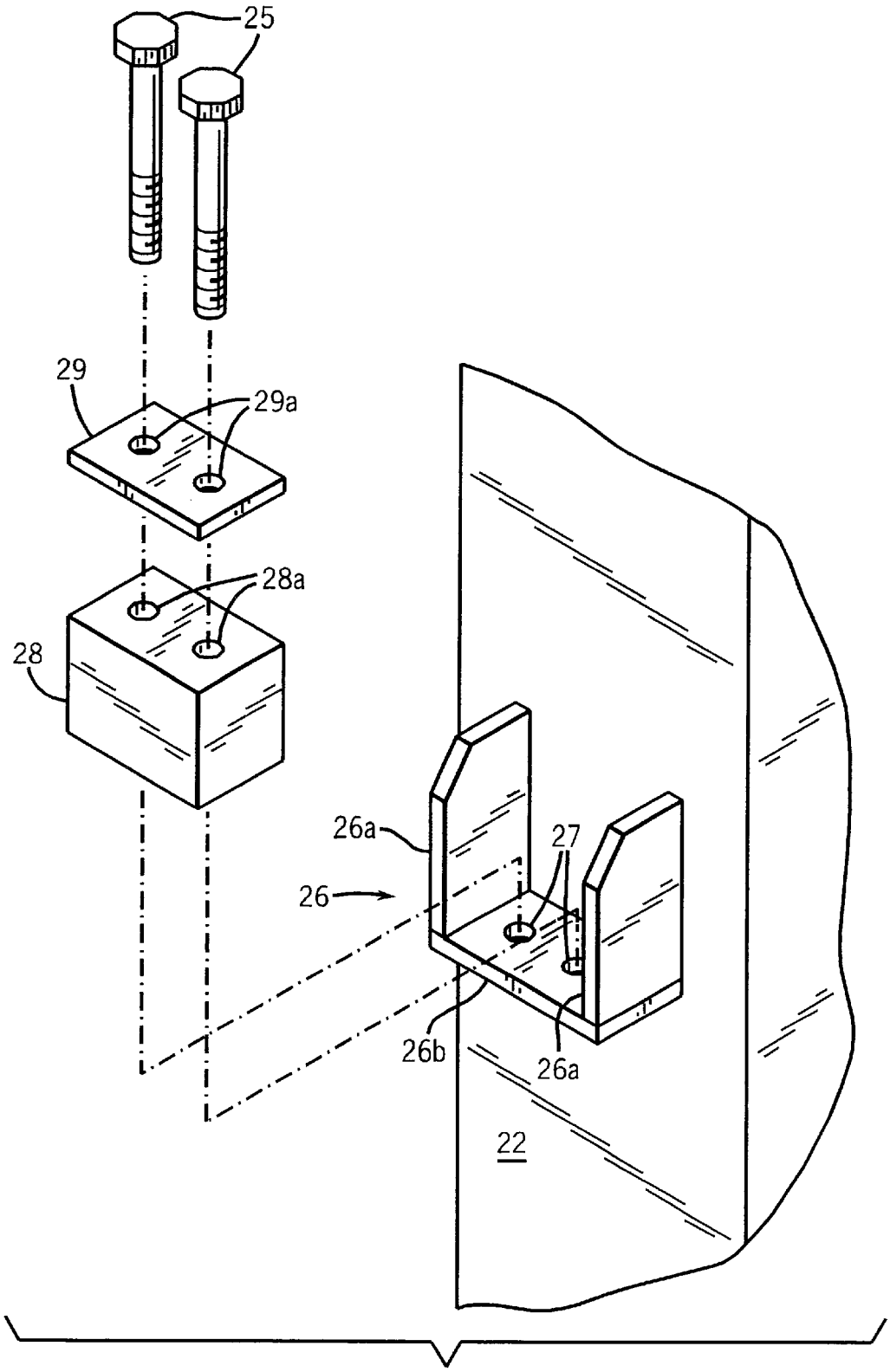
FIG. 4 is a perspective view of an isolator structure of the present invention.

FIG. 4 is a cutaway close-up view of the mast 22 illustrating an isolator structure 26. Isolator structure 26 comprises a bracket formed from a pair of vertical plates 26A attached to the mast 22 in parallel relation to one another, the lower ends of the vertical plates 26A having secured thereto a bottom plate 26B. Bottom 26B is secured to both the vertical plates 26A and to the mast 22. Bottom plate 26B has in one embodiment formed therethrough a pair of bolt holes 27, though the number of bolt holes may be varied. Vertical plates 26A and bottom plate 26B define a pocket into which sits an isolator buffer 28. Isolator buffer has formed there through bolt holes 28A which, when the isolator buffer 28 is received within the pocket formed by the vertical plates 26A and bottom plate 26B, are in registration with both holes 27 of the bottom plate 26B. Cover plate 29 is received over isolator buffer 28 when the isolator buffer 28 is received in the pocket. Cover plate 29 also has bolt holes 29A which are in registration with bolt holes 28A and bolt holes 27. Bolts 25 pass through cover plate 29, isolator buffer 28, and bottom plate 26 for the purpose of securing the upper flange 44 of the recoil assembly 40 to the guide column 20 of the rock breaking device 10 as illustrated in FIGS. 1 and 2. Nuts 25A thread onto bolts 25 to secure upper flange 44 to the under surface of the bottom plates 26 of the isolator structures 26.

The isolator structure 26 illustrated in FIG. 4 may further comprise a retaining plate (not shown) that will be affixed to the outer edges of the vertical plates 26A and bottom plate 26B. Such a retaining plate would act to more securely position the isolator buffer 28 within the isolator structure 26 and would further constrain the lateral expansion of the isolation buffer 28 as the isolation buffer is vertically compressed by bolts 25.

When excess force is applied to the recoil assemble 40, as when the tool 62 is "bottomed out," the recoil assembly 40 is forced downward. This excess force causes the recoil assembly to move downward with respect to the guide column 20. Rather than applying these forces directly to the guide column 20, the downward movement of the recoil assembly 40 causes the bolts 25 in the isolator structure 26 to compress the elastomeric isolator buffers 28 and absorb the excess forces that were applied to the recoil assembly 40.

As indicated above, the recoil assembly 40 comprises a recoil tube 42 having an upper flange 44 attached thereto at its upper end and lower flange 46 attached to its lower end. Secured between the upper flange and the lower flange 44, 46 are a number of reinforcing gussets 48. These gussets 48 are welded at their top edge to the under surface of the upper flange 44 and at their lower edge to the upper surface of the lower flange 46. Each gusset 48 is further welded at an inner edge to the recoil tube 42. Typically, at least four reinforcing gussets 48 are welded to the recoil assembly 40 to stiffen the recoil assembly 40.

Bolted to the lower flange 46 of the recoil assembly 40 is a tool holding structure 60. Referring to FIG. 2, the tool holding structure 60 is comprised of a nose block 64 which is in this embodiment of the present invention a steel rectangular solid having a bore 64A formed therethrough. The tool 62 is itself cylindrical in shape and has an upper surface 62A which is struck by impact weight 23. The lower end 62B of the tool 62 is the cutting end of the tool and may be flat, conical, pointed, or chisel shaped as needed. Tool 62 has a flat 63 machined into one side thereof. A retaining pin 66 is passed through a bore 66A in the nose block 64 and intersects the bore 64A so as to pass through the flat 63 machined into the tool 62. With the retaining pin 66 in place in the nose block 64, the vertical travel of the tool 62 is limited by the upper and lower ends of the flat 63.

The flat 63 machined into the tool 62 is arranged such that the lower end 62B of the tool 62 extends below the lower surface of the nose block 64. In addition, the upper end 62A of the tool 62 will extend above the upper surface of the nose block 64, through the lower flange 46 and into the space bounded by the recoil tube 42. At no time will the upper end 62A of the tool 62 be positioned below the upper surface of the nose block 64. The isolator structures 26 from which the recoil assembly depends, are spaced from the lower end of the mast 22 so as to insure that the lower end of the mast 22 is spaced away from the upper surface of the nose block 64 of the tool holding assembly 60. Ensuring that this space exists between the lower end of the mast 22 and upper surface of the nose block 64 prevents adverse impact between the lower end of the mast 22 and the nose block 64. The space between the lower end of the mast 22 and the upper surface of the nose block 64 is bounded by the walls of the recoil tube 42.

Typically, the recoil tube 42 is sized so as to provide clearance between the outer surface of the mast 22 and the inner surface of the recoil tube 42. This clearance prevents binding between the mast 22 and the recoil tube 42 when the impact of the impact weight 23 must be absorbed by the recoil assembly 40.

In order to further cushion the impact of the impact weight 23 upon the recoil assemble 40, a recoil buffer 68 having a bore 68A sized to accept the upper end 62A of tool 62 is disposed in the space between the upper surface of the nose block 64 and the lower end of the mast 22. In its normal operating position, the lower end 62B of the tool 62 will be placed on a rock to be broken and the upper end 62A of the tool 62 will extend upwardly through the nose block 64 and above the upper surface of recoil buffer 68. It is intended that the impact weight 23 first strike the upper surface 62A of the tool 62, thereby transmitting the majority of the energy of the impact weight 23 to the tool 62 for the purpose of breaking the rock positioned below the tool 62. As the tool 62 travels downward, the impact weight 23 comes into contact with the upper surface of the recoil buffer 68 which absorbs the forces not imparted to the tool 62 by the impact weight 23. The recoil buffer 68 is compressed vertically and simultaneously expands laterally towards the walls of the recoil tube 42. Where a great deal of force is applied to the recoil buffer 68, as where the tool is "bottomed out," i.e. the tool is forcefully driven into the retaining pin 66 because there is no rock beneath the tool 62 or because the rock has been broken, the lateral expansion of the recoil buffer 68 will bring the peripheral edges of the recoil buffer 68 into direct contact with the inner walls of the recoil tube 42. Because the outwardly directed forces applied to the inner walls of the recoil tube 42 by the compressed recoil buffer 68 can exceed the strength of the recoil tube 42, it is preferred to size the recoil buffer 68 to provide a space between the respective edges of the recoil buffer 68 and the inner walls of the recoil tube 42 to permit the recoil buffer 68 to absorb more force prior to coming into contact with the walls of the recoil tube 42. And because stresses may quickly become concentrated in the corners of a non-circular recoil tube, it is preferred to form a chamfer or radius CR at the corners of the recoil buffer 68 to provide a larger space for lateral expansion of the buffer 68 near the corners of a non-circular recoil tube 42. Alternatively, a circular recoil buffer 68 may be used.

The dimensions of the recoil buffer 68 and the expansion space provided between the periphery of the recoil buffer 68 and the interior walls of the recall tube are a function of the size of the rock breaking device and mass of the impact weight 23 being applied to the tool 62. The dimensions of the recoil buffer 68 and the spaces therearound must be arranged so as to minimize the stresses applied laterally to the walls of the recoil tube 42.

It is preferred that an elastomeric material such as polyurethane or rubber may be used in fabricating a recoil buffer 68 for use with the present invention. The elastomeric material must be formulated to be sufficiently stiff and sufficiently resistant to breakdown due to the constant pounding of the impact weight 23. It must also be understood that any material having suitable spring coefficients and compressibility characteristics may be used.

One embodiment of the present invention utilizes a recoil buffer 68 that is 5" thick and 14¾" square. The square recoil tube 42 of this embodiment has an inner diameter of approximately 18½". The impact weight 23 used with this embodiment weighs approximately 4,200 pounds.

Figure 5:
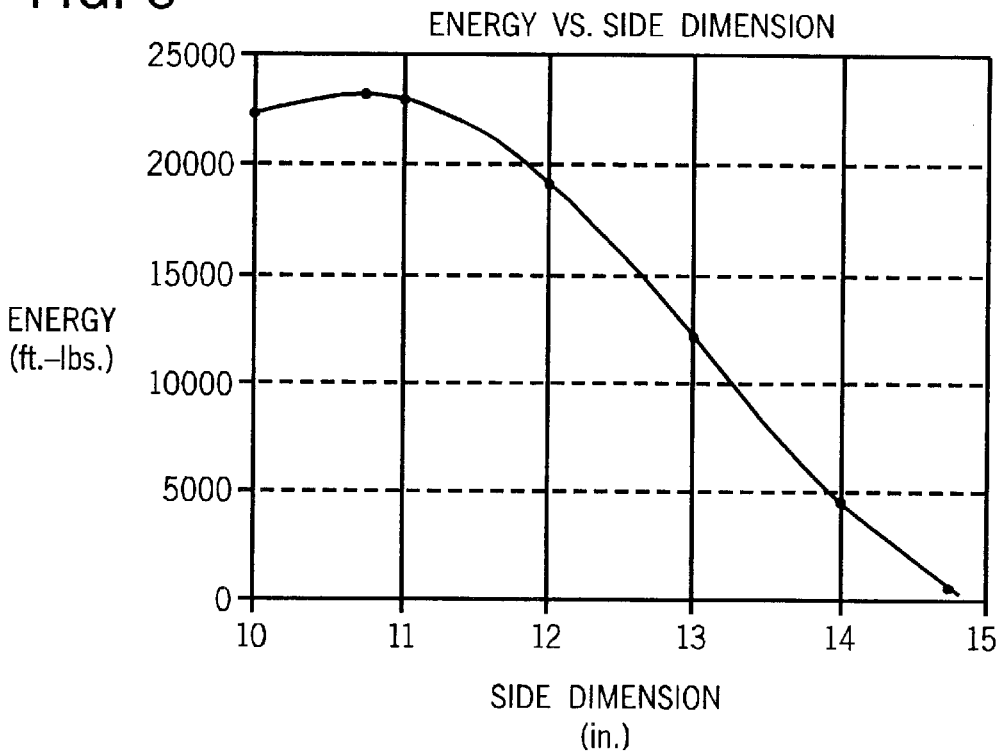
FIG. 5 is a graph of the energy absorbed by variously dimensioned recoil buffers at the point where the recoil buffer comes into contact with the walls of the recoil tube.

FIG. 5 is a graph which illustrated the quantity of energy, in ft.-lbs., that is absorbed by the recoil buffer 68 at the point at which the recoil buffer 68 totally fills the space available within the walls of the recoil tube 44 and goes solid, transmitting the remaining energy to the walls of the recoil tube 42 itself.

Figure 6:
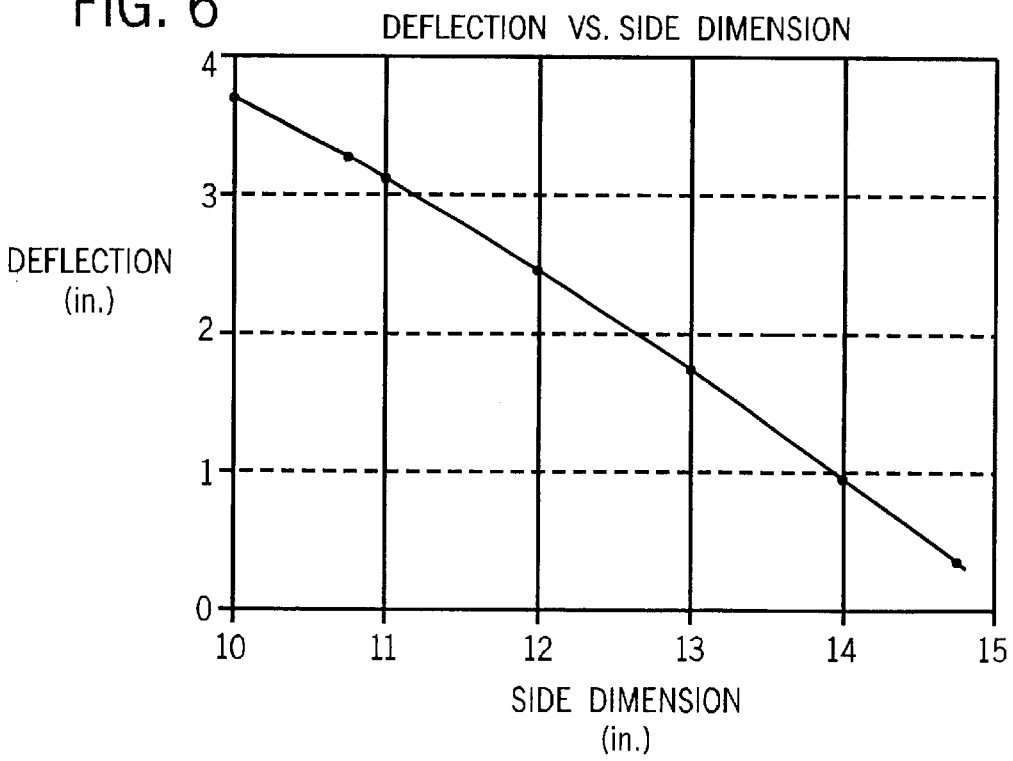
FIG. 6 is a graph of the deflection of variously dimensioned recoil buffers at the point where the recoil buffer comes into contact with the walls of the recoil tube; and, FIG. 7 is a cross section of an alternate embodiment of the present invention that omits the use of a recoil tube.

FIG. 6 illustrates the magnitude of the vertical compression of the recoil buffer 68 at the point at which the recoil buffer 68 fills the space defined by the walls of the recoil 42 and begins to transmit the remaining energy of the impact weight 23 to the walls of the recoil tube 42 themselves. The variable in both FIGS. 5 and 6 is the dimension of a side of a square recoil buffer 68. By varying the length of a side of a square recoil buffer 68 it can be seen that the ability of the recoil buffer 68 to absorb energy is altered. Given the combination of deflection and absorption characteristics of the polyurethane recoil buffer 68, for an impact weight 23 of approximately 4200 pounds it has been determined that a range of size lengths for a square recoil buffer would preferably be in the range of 10¾" to 14¾".

Because the lateral forces applied to the walls of the recoil tube 42 can only be minimized, and not prevented, it is preferred to position reinforcing plates 70 around the interior of the recoil tube so as to present a stronger wall to the lateral expansion of the recoil buffer 68. The decreased space between the periphery of the recoil buffer 68 and the inner surface of the recoil tube 42 as defined by the inner surface of the reinforcing plates 70 must be taken into account when sizing the recoil buffer 68. In the above described specific embodiment of the present invention, there is a ⅜" gap between the periphery of the recoil buffer 68 and the reinforcing plates 70.

The rock breaking device 10 of the present invention is used to break up rocks that are present in quarrying and mining sites. It may also be used for the purpose of driving piles. In breaking a targeted rock, the rock breaking device is brought into position adjacent the targeted rock by driving the vehicle which mounts the rock breaking device 10 up to the targeted rock. The arms of the vehicle are then used to orient the rock breaking device 10 over the targeted rock so as to position the lower end 62B of the tool 62 on the targeted rock. Once the tool 62 has been properly located above the targeted rock, the impact weight 23 is raised by the weight raising mechanism 30 within the guide column 20. The raised impact weight 23 is then released by the weight raising mechanism 30, thereby causing the potential energy of the raised impact weight 23 to be translated into kinetic energy which is in turn transmitted through the tool 62 to the targeted rock. The tool 62 is then repositioned to either direct a second impact to the targeted rock or to put the tool 62 into contact with a second rock that is to be broken. The weight is again raised and released until the rock or rocks are broken.

If the impact weight 23 is released by the weight raising mechanism 30 without a rock being positioned under the tool 62, it is very probable that the impact weight 23 will bottom out the tool 62 against the retaining pin 66. This situation is highly undesirable in that such impacts may damage or break the retaining pin 66, thereby necessitating repair to the rock breaking device 10. However, the recoil assembly 40 is arranged and constructed such that the forces imparted to the bottomed out tool 62 will be absorbed by the recoil buffer 68 and also by the isolator buffers 28. The recoil buffer 68 and the isolator buffers 28 prevent damage to the guide column 20 and to the nose block 64. In order to prevent serious damage to the rock breaking device 10, the material from which the retaining pin 66 is designed is arranged and constructed such that the retaining pin 66 will fail before the nose block 64 or the guide column 20 are damaged or destroyed. The idea being that the destruction of the retaining pin 66 will absorb additional energy which would otherwise be applied in a destructive manner to the recoil assembly 40 and the guide column 20.

Figure 7:
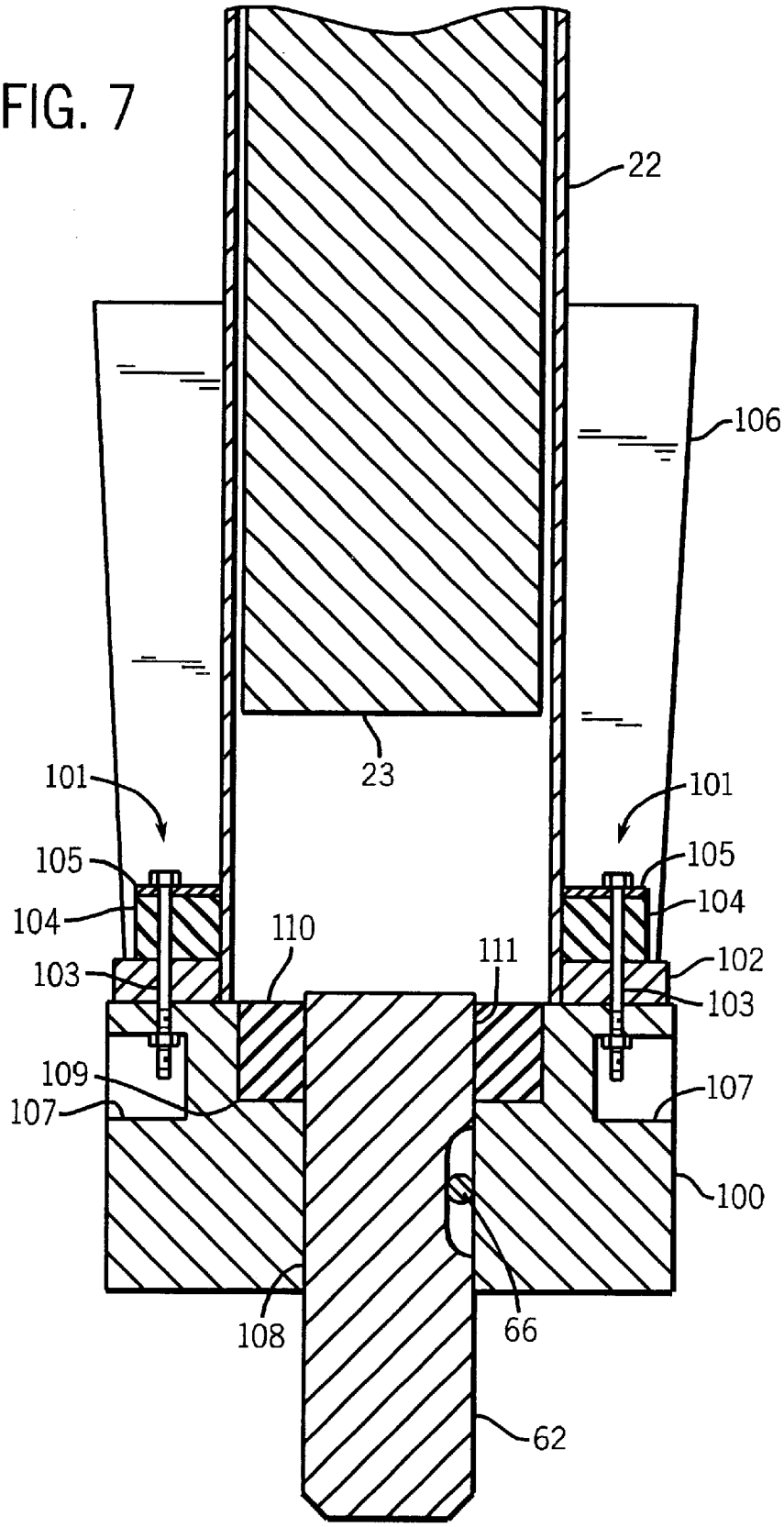

Referring next to FIG. 7, an alternate embodiment of the present invention may be seen. In this embodiment, the recoil tube has been omitted and the nose block 100 has been secured directly to the mast 22 by means of isolating structures 101. A flange 102 is welded to the lower end of the mast 22 and has bolt holes formed therethrough to accommodate bolts 103 of the isolating structures 101. The isolator structures 101 illustrated in FIG. 7 comprise an isolator buffer 104 which rests upon an upper surface of the flange 102. A cover plate 105 rests atop the isolator buffers 104 to spread compression forces evenly across the isolator buffer 104. Preferably the isolator buffers 104 are received tightly between gusset plates 106 that are secured to the exterior of the lower end of the mast 22 as by welding. These gusset plates 106 are also preferably secured to the mast flange 102.

In the embodiment of FIG. 7 the mast 22 is reinforced by twelve gusset plates 106 arranged in groups of three set ninety degrees from one another on the exterior of the mast 22. As indicated above, the isolator buffers 104 are preferably received securely between the gusset plates 106. Where there are four sets of three gusset plates secured to the exterior of the lower end of the mast 22 as described, four pairs of isolating structures 101 will be disposed between the gusset plates 106, one pair of isolating structures 101 to each set of three gusset plates 106, to secure the nose block 100 to the mast 22. In some instances it may be necessary to omit the gusset plates 106 and the flange 103 and in these cases, an isolating structure 26 comprising a bracket made up of side plates 26*a* and bottom plates 26*b* as illustrated in FIG. 1 may be used in place of the isolating structures 101 illustrated in FIG. 7 for securing the nose block to the mast 22. It is to be understood that the number, arrangement, and construction of the gussets 106 may vary to suit a given application and yet not exceed the scope of the present invention. What is more, the number and arrangement of isolating structures 101 may be varied without exceeding the broad scope of the present invention, e.g. isolator structures 101 may be arranged around the entire perimeter of the flange 102.

The bolts 103 of isolating structures 101 pass through cover plates 105, isolator buffers 104 and flange 102 and into nose block 100. In the embodiment of FIG. 7, the nose block 100 has been provided with bolt recesses 107 to allow a fastener such as a nut to be threaded onto the ends of bolts 103 which extend into bolt recesses 107. Alternatively, the bolt holes formed in the nose block 100 may be tapped so that bolts 103 may be threaded directly into the nose block 100 without the need of nuts or similar fasteners. In this case the bolt recesses 107 would be omitted.

Nose block 100 has a bore 108 formed therethrough to slidably receive a tool therein. The tool 62 is retained in the bore 108 by pin 66 in the same manner as described in conjunction with FIGS. 1–2. Nose block 100 also has a recoil buffer recess 109 formed therein as illustrated in FIG. 7. Recoil buffer recess 109 is preferably concentric with or at least aligned with the bore 108 in the nose block 100. Recoil buffer recess 109 is sized to receive therein a recoil buffer 110 having a bore 111 formed therethrough to allow the upper end of the tool 62 to pass therethrough. The recoil buffer 110 may be sized to maintain a small gap between the interior surfaces of the nose block 100 in the recoil buffer recess 109, or, if so desired, the periphery of the recoil buffer 110 may be in substantially complete contact with the side surfaces of the recoil buffer recess 109. Given the mass of the nose block 100, there is typically no need to reinforce the recoil buffer recess 109. One constraint upon the arrangement of the recoil buffer recess is that the recess 109 must be larger than the lower surface 23*a* of the weight 23 so that the impact of the weight 23 is upon the recoil buffer 110 and not upon the nose block 100 itself. To prevent damage to the mast 22, it is important that the recoil buffer 110 remain completely within the recess 109 in the nose block 100.

The isolator structures 101 of the embodiment of FIG. 7 function exactly as the isolator structures 26 described above in preventing damage to the guide column 20 of the rock breaking device 10. Similarly, the recoil buffer 110 acts in the same manner as recoil buffer 68 to absorb and dissipate impact forces that would otherwise be imparted directly to the nose block and subsequently to the guide column 20.

This description is intended to provide a specific example of an individual embodiment which clearly discloses the rock breaking device of the present invention. Accordingly, the invention is not limited to the described embodiment or to the use of the specific elements described herein. All alternative modifications and variations of the present invention which fall within the spirit and broad scope of the appended claims are cover.

What is claimed is:

1. A device for breaking rocks comprising:

a) a hollow tube having a weight slidably disposed therein;

b) a weight raising device for raising and releasing said weight to allow said weight to fall within said tube under the influence of gravity;

c) an attachment structure connected to said hollow tube for securing said device for breaking rocks to one of a stationary object and a vehicle;

d) a recoil tube telescopically received over a lower end of said hollow tube said recoil tube being resiliently secured to said hollow tube, a lower end of said recoil tube extending below said lower end of said hollow tube;

e) a nose block secured to said lower end of said recoil tube, said nose block having a bore formed therethrough constructed and arranged to slidably receive a tool therein, said tool being retained in said bore in said nose block by a pin passed through said nose block, said tool having a flat machined into a side thereof to permit said pin to intersect and pass through said bore, thereby retaining said tool in said bore; and, f) an elastomeric recoil buffer disposed within said recoil tube in a space defined between said lower end of said hollow tube and an upper surface of said nose block, said recoil buffer having a bore formed therethrough in alignment with said nose block bore to allow an upper end of said tool to extend above said recoil buffer so that said weight may impact said tool directly, said recoil buffer being constructed and arranged to resiliently absorb impact forces imparted thereto by said weight.

2. The device for breaking rocks of claim 1 further comprising a reinforcing structure disposed within, and affixed to, said recoil tube around said recoil buffer, said recoil buffer and said reinforcing structure being sized so as to create a gap between the periphery of said recoil buffer and said reinforcing structure.

3. The device for breaking rocks of claim 2 wherein the recoil buffer will be vertically compressed by the impact of said weight and will expand laterally to contact said reinforcing structures, said recoil buffer thereby dissipating at least a portion of said impact of said weight.

4. The device for breaking rocks of claim 1 wherein said recoil tube is resiliently suspended from said hollow tube by a plurality of isolator structures comprising:

a) a bracket constructed and arranged to receive therein an elastomeric isolator buffer and a cover plate that is placed over said isolator buffer to sandwich said isolator buffer between said bracket and said cover plate, said cover plate, isolator buffer and bracket having at least one bolt hole bored therethrough, permitting at least one connecting bolt to be passed therethrough and into an upper flange of said recoil tube so as to resiliently secure the recoil tube to said hollow tube such that when impact forces are applied to said recoil tube so as to force said recoil tube downward, said connecting bolt will bear down on said cover plates which in turn compress said isolator buffers in a resilient manner, said isolator buffers regaining their original dimensions after said impact forces have been absorbed and dissipated by said isolator buffer.

5. The device for breaking rocks of claim 4 wherein said recoil tube further comprises a plurality of plate shaped reinforcing gussets affixed to an outer surface thereof so as to increase the stiffness of said recoil tube.

6. The device for breaking rocks of claim 4 wherein said device comprises at least four isolating structures arranged around said recoil tube 90° from one another.

7. The device for breaking rocks of claim 1 wherein said hollow tube and said recoil tube have a cross section that is rectangular.

8. The device for breaking rocks of claim 1 wherein said hollow tube and said recoil tube have a cross section that is curvilinear.

9. The device for breaking rocks of claim 1 wherein the recoil buffer is rectangular in cross section and has radiused corners.

10. The device for breaking rocks of claim 1 wherein the recoil buffer is rectangular in cross section and has chamfered corners.

11. The device for breaking rocks of claim 1 wherein said weight raising mechanism is a hydraulic mechanism.

12. The device for breaking rocks of claim 1 wherein said weight raising mechanism is a pneumatic mechanism.

13. The device for breaking rocks of claim 1 wherein said weight raising mechanism comprises an internal combustion mechanism.

14. The device for breaking rocks of claim 1 wherein said attachment structure is arranged to be secured to a front end loader.

15. The device for breaking rocks of claim 1 wherein said attachment structure is arranged to be secured to an excavator.

16. A device for breaking rocks comprising:

a) a tubular mast having a top end and a bottom end and a channel formed therethrough from said top end to said bottom end;

b) a weight for delivering an impact, said weight traveling through said channel of said mast;

c) a weight raising mechanism, said weight raising mechanism coupled to said weight, said weight raising mechanism being capable of raising said weight from said bottom end of said mast to said top end of said mast, and further capable of releasing said weight so that said weight may fall under the influence of gravity to said bottom end of said mast;

d) an attachment structure secured to said mast, said attachment structure being arranged and constructed to secure said mast to one of a vehicle and a stationary object which support said device; and e) a recoil assembly secured to said bottom end of said mast, said recoil assembly comprising:

i) a plurality of isolator structures secured to said mast a predetermined distance from said bottom end of said mast;

ii) a tool holding structure comprising a nose block secured to said mast by said isolator structures;

iii) a tool for striking a rock slidably received in a bore formed through said nose block of said tool holding structure, said tool being generally cylindrical and having a flat formed into a side thereof, a retaining pin passing through said nose block so as to intersect said bore of said nose block and to further intersect said flat formed into said tool, said retaining pin limiting motion of said tool within said nose block;

iv) a recess formed into an upper surface of said nose block, said recess being at least as large as the lower surface of said weight, said recess being substantially aligned with said channel of said mast; and, v) a recoil buffer disposed within said recess, said recoil buffer having a bore formed therethrough in registration with said bore of said nose block such that said tool may pass therethrough, said upper surface of said tool being capable of being positioned above an upper surface of said recoil buffer such that said weight will deliver an impact to said upper surface of said tool when said weight is released to fall to said bottom end of said mast; said impact forcing said upper surface of said tool downward and below an upper surface of said recoil buffer such that said weight comes into contact with said recoil buffer.

17. A device for breaking rocks comprising:

a) a hollow tube having a weight slidably disposed therein;

b) a weight raising device coupled to said weight for raising and releasing said weight to allow said weight to fall with said tube under the influence of gravity;

c) an attachment structure connected to said hollow tube for securing said device for breaking rocks to one of a stationary object and a vehicle;

d) a nose block resiliently secured to said lower end of said hollow tube, said nose block having a bore formed therethrough constructed and arranged to slidably receive a tool therein, said tool being retained in said bore in said nose block by a pin passed through said nose block, said tool having a flat machined therein to permit said pin to intersect and pass through said bore, thereby retaining said tool in said bore, said nose block further having a recess of at least the same size as the lower surface of said weight formed into an upper surface thereof around said bore; and, e) a recoil buffer disposed entirely within said recess in said nose block, said recoil buffer having a bore formed therethrough in alignment with said nose block bore to allow an upper end of said tool to extend above said recoil buffer so that said weight may impact said tool directly, said recoil buffer being constructed and arranged to resiliently absorb impact forces imparted thereto by said weight.

18. The device for breaking rocks of claim 17 wherein said nose block is resiliently secured to said hollow tube by a plurality of isolator structures comprising:

a) an elastomeric isolator buffer and a cover plate, said isolator buffer and said cover plate being located on an upper surface of a flange secured to said lower end of said hollow tube, said isolator buffer being sandwiched between said cover plate and said flange, said isolator buffer and said cover plate having at least one bolt hole bored therethrough to permit at least one connecting bolt to be passed through a complementary hole in said flange and into said nose block so as to resiliently secure said nose block to said flange of said hollow tube in a manner such that when impact forces are applied to said nose block so as to force said nose block downward, said connecting bolt will bear down on said cover plate and in turn compress said isolator buffer in a resilient manner, said isolator buffer regaining its original dimensions when said impact forces have been absorbed and dissipated by said isolator buffer.

* * * * *